US005205696A

United States Patent [19]

Andreasen

[11] Patent Number: 5,205,696

[45] Date of Patent: Apr. 27, 1993

[54] DUMPING SYSTEM FOR A KILN FLOOR

[76] Inventor: Norman H. Andreasen, 1522 Norwood Ave., Itasca, Ill. 60143

[21] Appl. No.: 522,903

[22] Filed: May 14, 1990

[51] Int. Cl.[5] ..... F16H 21/44

[52] U.S. Cl. ..... 414/287; 34/237; 110/168; 105/240; 74/79; 298/35 M; 222/503; 222/504; 222/484

[58] Field of Search ..... 414/286, 287, 917, 160; 34/168, 172, 176, 165, 237, 238; 49/110, 394, 395, 280; 105/289, 304, 239, 311.1, 308.1, 240; 298/24, 27, 28, 30, 35 M; 74/79.1; 222/504, 503, 506, 484

[56] References Cited

U.S. PATENT DOCUMENTS

| | | | |
|---|---|---|---|
| 482,235 | 9/1892 | Eads | 110/168 |
| 747,143 | 12/1903 | Colby | 34/237 |
| 838,740 | 12/1906 | Nettleton | 110/168 |
| 1,564,813 | 12/1925 | Babendreier | 110/276 |
| 3,225,721 | 12/1965 | Rowley | 110/168 X |
| 3,243,894 | 4/1966 | Ricklick | 34/237 |
| 3,391,653 | 7/1968 | DeRidder | 105/240 |
| 3,401,644 | 9/1968 | Cripe | 105/240 |
| 3,710,729 | 1/1973 | Schuller | 105/240 |
| 4,462,266 | 7/1984 | Andreasen | 74/79.1 |
| 4,508,037 | 4/1985 | Rousseau | 105/304 X |
| 4,843,974 | 7/1989 | Ritter et al. | 105/240 |

*Primary Examiner*—Frank E. Werner
*Attorney, Agent, or Firm*—Edward D. Gilhooly

[57] ABSTRACT

A dumping system for a kiln floor having a pnematic cylinder to cause a plurality of rows of tray assemblies to move between a closed postion and an open position. A harmonizing bar assembly is connected to the rows of tray assemblies and acts to synchronize movement of the tray assemblies and locks the tray assemblies in a fully clsoed or open position. The linkage between the pneumatic cylinder and the rows of tray assemblies includes a device to adjust the connection with the shaft supporting the tray assemblies.

14 Claims, 8 Drawing Sheets

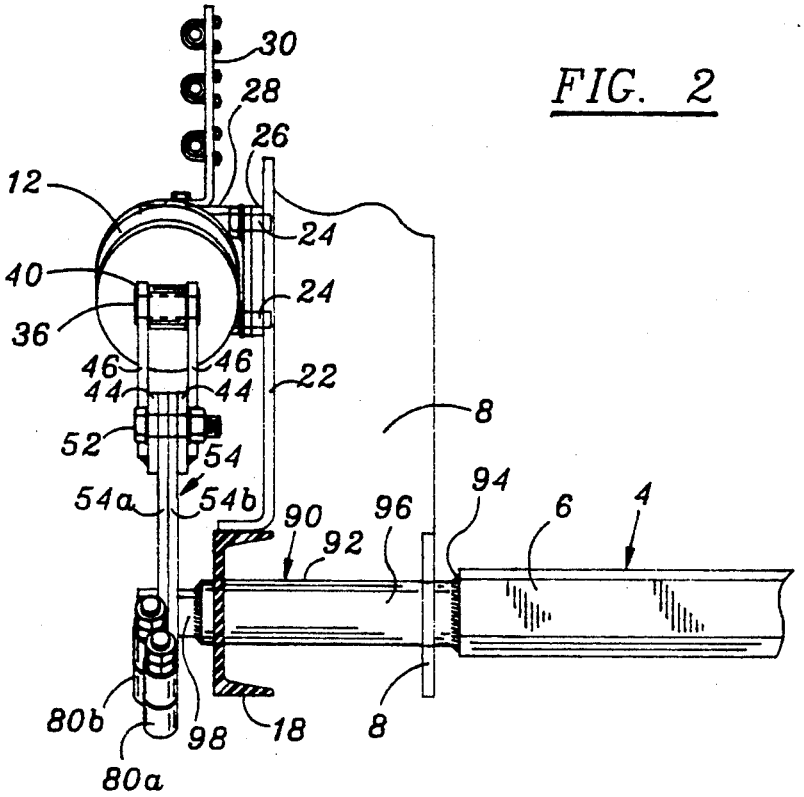
FIG. 2
FIG 3
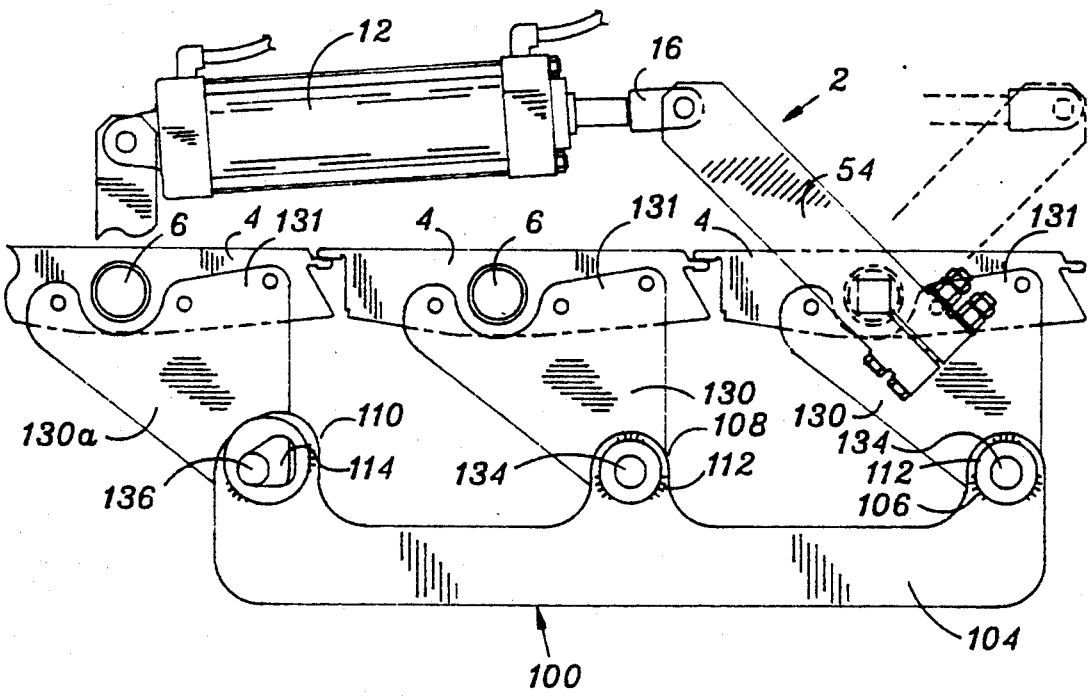

56
57
58
60
62
54
54a
54b
72
76
78
80
80a
80b
81a
81b
82a
82b

DUMPING SYSTEM FOR A KILN FLOOR

BACKGROUND OF THE INVENTION

1. Field of the Invention

The invention relates in general to kiln floors and more particularly, to a dumping system for a kiln floor.

2. Description of the Prior Art

It has been a long practice to dry grain with a kiln floor and subsequently dump the floor for later use of the grain in the brewing process. The malt being processed in the malt house typically may pile two or three feet high over a kiln floor at a density of approximately 180 to 120 pounds per square foot. Because of the large quantity of material being dried on the kiln, the floor has conventionally comprised a number of pivotal sections that allow the grain to dump on a sequential basis and minimize the forces required in the discharge process. Such floor sections have in the past been manually operated by a crew who progress down the length of the floor in an aisle and physically rotate each floor section until the floor is totally dumped. Not only is such manual operation an arduous and unpleasant task because of the work exerted and unhealthy surrounding conditions, a manually operated kiln floor requires a relatively long period of labor to complete the dumping sequence. An example of prior malt driers having manually operated panels is shown in U.S. Pat. No. 355,128 to Brada issued Dec. 28, 1886 and U.S. Pat. No. 588,507 to Toepfer issued Aug. 17, 1897.

In recent years several automated kiln floors have been introduced to the industry to overcome the inherent problems associated with manual operation, even though large numbers of manually operated kiln floors still exist at present time. An example of an automated malt house kiln is disclosed in the Ricklick patent, U.S. Pat. No. 3,243,894 issued Apr. 5, 1966. Several disadvantages associated with the foregoing automated system are alleviated by the systems disclosed in my prior U.S. Pat. Nos. 4,446,751; 4,462,266; 4,472,070; 4,498,269; and 4,522,320. While the techniques shown in my prior foregoing prior patents have solved numerous problems in the industry, a need persists for the introduction of additional designs for automated kiln floors that are economical and efficient and can be installed in new malt houses, or to replace or adapt to existing floors.

SUMMARY OF THE INVENTION

It is therefore an objective of the present invention to provide an improved dumping system for use in a kiln floor. The invention of the application is directed to provide a less costly and more efficient system. The dumping system of the application is not only suitable for new construction, but is also suitable to rebuild old kilns or to be used in conjunction with an older kiln system to attain greater efficiency. In the latter situation, it permits restoration of older existing equipment to extend service life with minimal investment. The dumping system herein disclosed utilizes pneumatic cylinders that are operatively affixed to provide sequential dumping of the grain. The pneumatic power devices are uniquely mounted adjacent the pivotal tray through an improved linkage and actuator means assuring optimal operation. The pivotal action of the floor panels, both in dumping and closing, is enhanced by a harmonizing bar assembly which particularly is useful in situations in which a particular pneumatic cylinder is linked for operation with a plurality of rows of tray assemblies. The harmonizing bar assembly is mounted on the opposite side of the floor from the pneumatic devices and stabilizes and locks the trays in a closed or open configuration. The latter feature further insures a smooth and synchronized dumping or closing sequence of the trays in cooperation with the action of the pneumatic cylinders. The system also permits service personnel to safely walk on the floor without any chance of opening the floor independently of the control system.

The invention thus permits the installation of a highly effective dumping arrangement in a new malt house or effective repair or modification of existing floors. The design of the components of the system of the application permits economical manufacturing techniques, such by stamping and the like, to reduce the investment costs in providing an advanced and efficient kiln floor.

BRIEF DESCRIPTION OF THE DRAWINGS

FIG. 2 is a partial end elevational view, with parts in section, of the dumping system for a kiln floor taken along lines 2—2 of FIG. 1;

FIG. 3 is a partial elevational view, with parts shown in phantom, of a second embodiment of the dumping system for a kiln floor of the invention.

DESCRIPTION OF PREFERRED EMBODIMENTS

Figure 1:
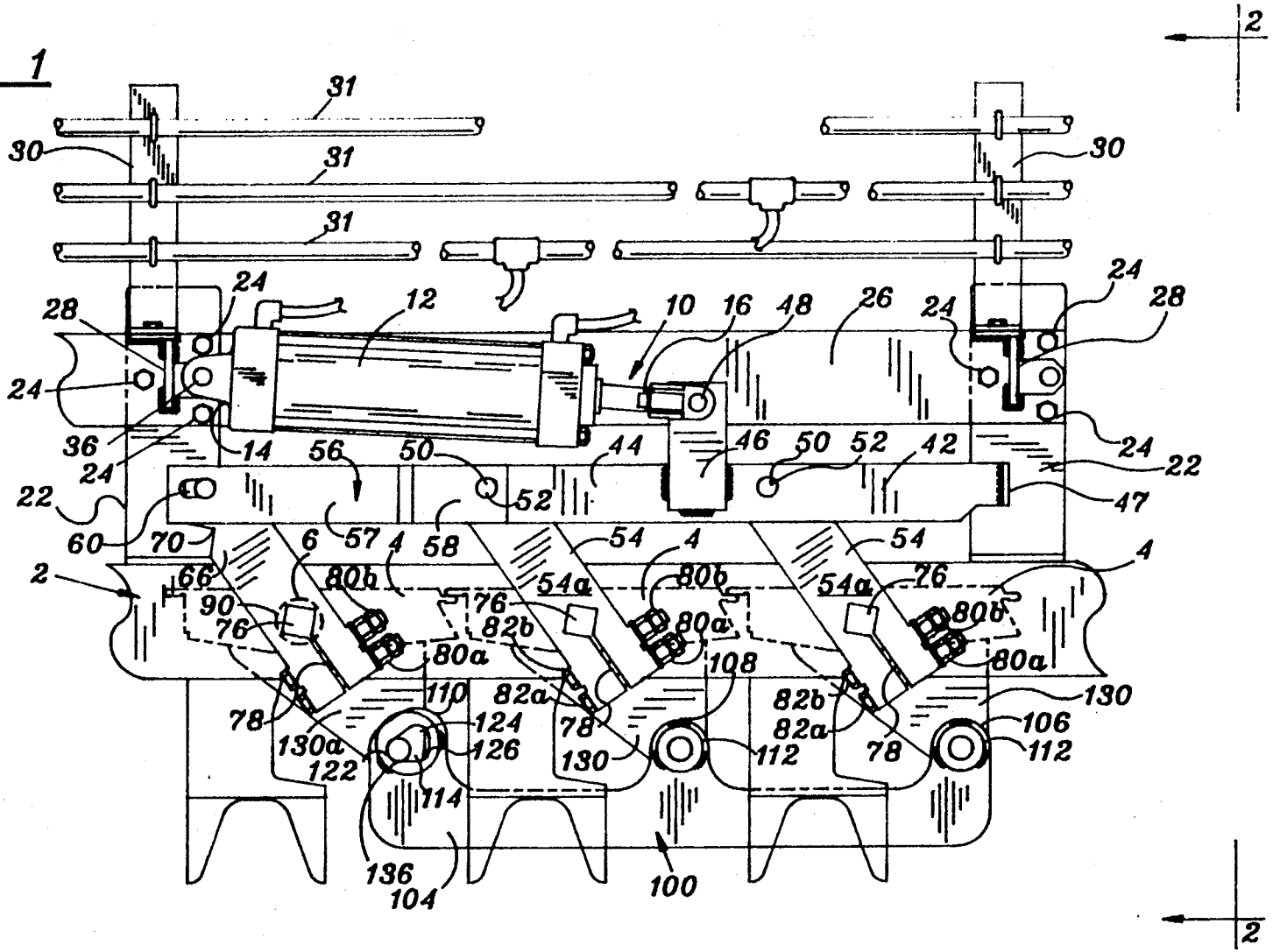
FIG. 1 is a partial side elevational view, with parts shown in phantom, of a first embodiment of the dumping system for a kiln floor of the invention.
Figure 16:
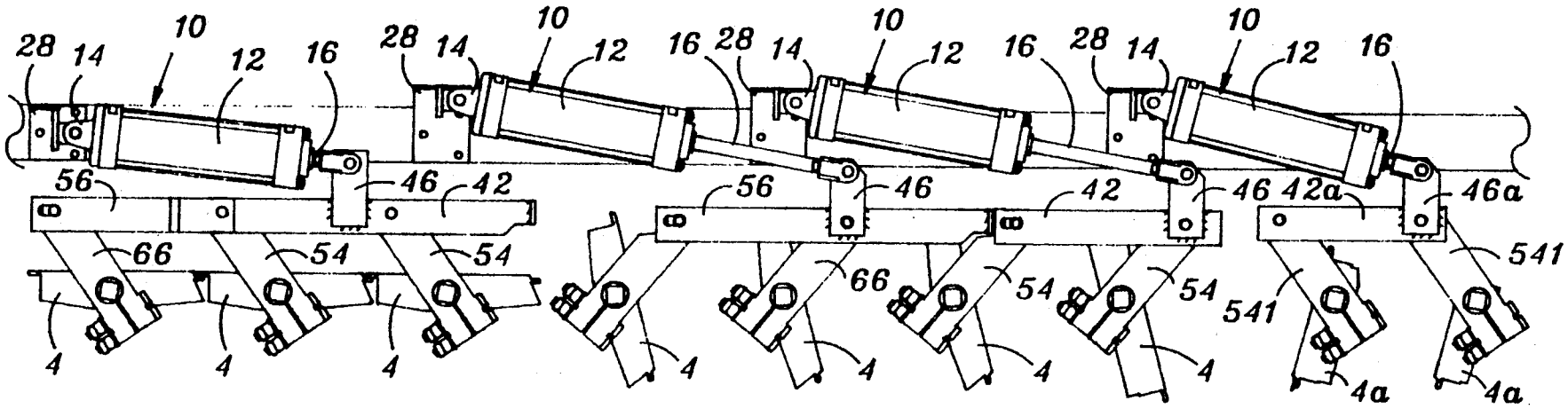
FIG. 16 is a side elevational view of a portion of the dump assembly of FIG. 1 showing its respective use with a plurality of pneumatic cylinders.

Referring to FIG. 1, there is shown a portion of a kiln floor 2 comprising a plurality of rows of tray assemblies 4. Each of the rows of tray assemblies 4 includes a plurality of aligned tray assemblies that open and close as a row about a common pivotal axis formed on shaft or tube 6 (FIG. 2) extending perpendicular to the view of FIG. 1. Although three separate rows of tray assemblies are shown in FIG. 1, the kiln floor includes a plurality of such rows, the dumping and closing of which are controlled by dumping system 2, as shown in FIG. 16. As seen in FIG. 2, one end of the shafts or tubes 6 are rotatably mounted on a wall 8 separating the tray assemblies 4 from an aisle area. The far end of the shafts or tubes 6 are mounted on bearings (not shown) carried on the opposite wall (not shown) of the kiln house.

As is well known the tray assemblies 4 carry a load of malted grain in their horizontal, closed position during the drying cycle of the kiln. After the drying process is completed, the rows of tray assemblies 4 must be pivoted about tube 6 to an approximate vertical orientation to dump the dried grain downward to a collection system.

Referring to FIGS. 1 and 16, the improved dumping system of the invention, generally designated by reference numeral 10, is illustrated. The dumping of each row of tray assemblies 4 is effected by means of a pneumatic cylinder 12 pivotally mounted at its base 14 and having an extensible end 16. Although the pneumatic cylinder 12 is illustrated as connected to three rows of trays in FIG. 1 as will be apparent, it is within the scope of the invention to attach a respective pneumatic cylinder 12 to less or more than three rows of tray assemblies 4 along the length of the kiln floor as dumping system 10*a* is seen in FIG. 16. As best seen in FIG. 2, the pneumatic cylinder 12 is mounted on the outside surface of wall 8 within the aisle areas traditionally provided in a malt house. A plurality of pneumatic cylinders 12 are mounted along the wall 8 of a number sufficient to open or close the number of tray assemblies 4 along the length of the floor. Extension of extensible end 16 of pneumatic cylinder 12 will act to pivot the tray assemblies 4, while withdrawal of the extensible end 16 will close the tray assemblies 4 to a horizontal, closed orientation. As illustrated in FIG. 16, the pneumatic cylinders 12 are sequentially operated along the floor as some of the tray assemblies 4 are in the closed configuration in the sequence shown in FIG. 16.

Referring to FIGS. 1 and 2, the mounting of a pneumatic cylinder 12 to the wall 8 is best shown. A channel 18 is affixed to a lower portion of wall 8. A pair of wall stands 22 are welded to the top of channel 18. Although two wall stands 22 are shown in FIGS. 1 and 2, a plurality of wall stands 22 are mounted along wall 8 to support a respective pneumatic cylinder 12. Each wall stand 22 is provided with at least two outwardly extending studs 24 (three being shown) on which a cylinder support bar 26 is horizontally affixed. A clevis assembly 28 is welded to the cylinder support bar 26 adjacent wall stands 22. A bracket 30 is affixed to the upper sections 32 of the clevis assembly 28 and supports two or more, three being shown, separate pneumatic manifolds 31 that are in fluid communication with the plurality of pneumatic cylinders 12 along the floor or aisle wall. A pin 36 affixes the spaced ends 38 of the fixed end 14 (one of which is shown in FIG. 1) of the pneumatic cylinder 12 in hole 40 provided in clevis assembly 28 to provide a fixed pivotal mounting of the pneumatic cylinder 12. As seen in FIG. 1, the right clevis assembly 28 is used to mount the fixed end 14 of a pneumatic cylinder (not shown) used to operate the adjoining three or other number of rows of tray assemblies (not shown). It should be apparent that a plurality of wall stands 22 and clevis assemblies 28 are mounted along the wall 8 to support the plurality of pneumatic cylinders 12 used to dump the plurality of rows of tray assemblies 4 of the system.

Referring to FIGS. 1,6, 7, and 16, a dump bar linkage 42 having a pair of parallel horizontal bars 44 and a pair of aligned upper plates 46 connects the extensible end 16 of pneumatic cylinder 12 to the three rows of tray assemblies 4 to be opened or closed. An end plate 47 is welded to the ends of bars 44 for support. The extensible end 16 of the pneumatic cylinder 12 is pivotally affixed to a hole of the upper plate 46 by a pin 48. The bars 44 include two aligned holes 50 in which nut and bolt assemblies 52 affix the dump bar levers 54 of two of the tray assemblies 4 being controlled by pneumatic cylinder 12.

In FIGS. 1, 12, 13, and 16, an extension 56 attached to an end of dump bar linkage 42 is shown. The extension 56 includes a pair of spaced bars 57 having oppositely oriented offset portions 58. The offset portions 58 surround an end portion of dump bar linkage 42 (FIG. 1) for attachment thereto. The end portion of bars are provided with aligned oblong holes 60. A second hole 62 is provided in the offset portions 58 to permit attachment of the extension 56 to dump bar linkage 42 through use of one of the nut and bolt assemblies 52 which attaches a dump bar levers 54. The nut and bolt assembly 63 supports a dump bar lever 66 to be described.

Figures 12, 13, 14, 15:
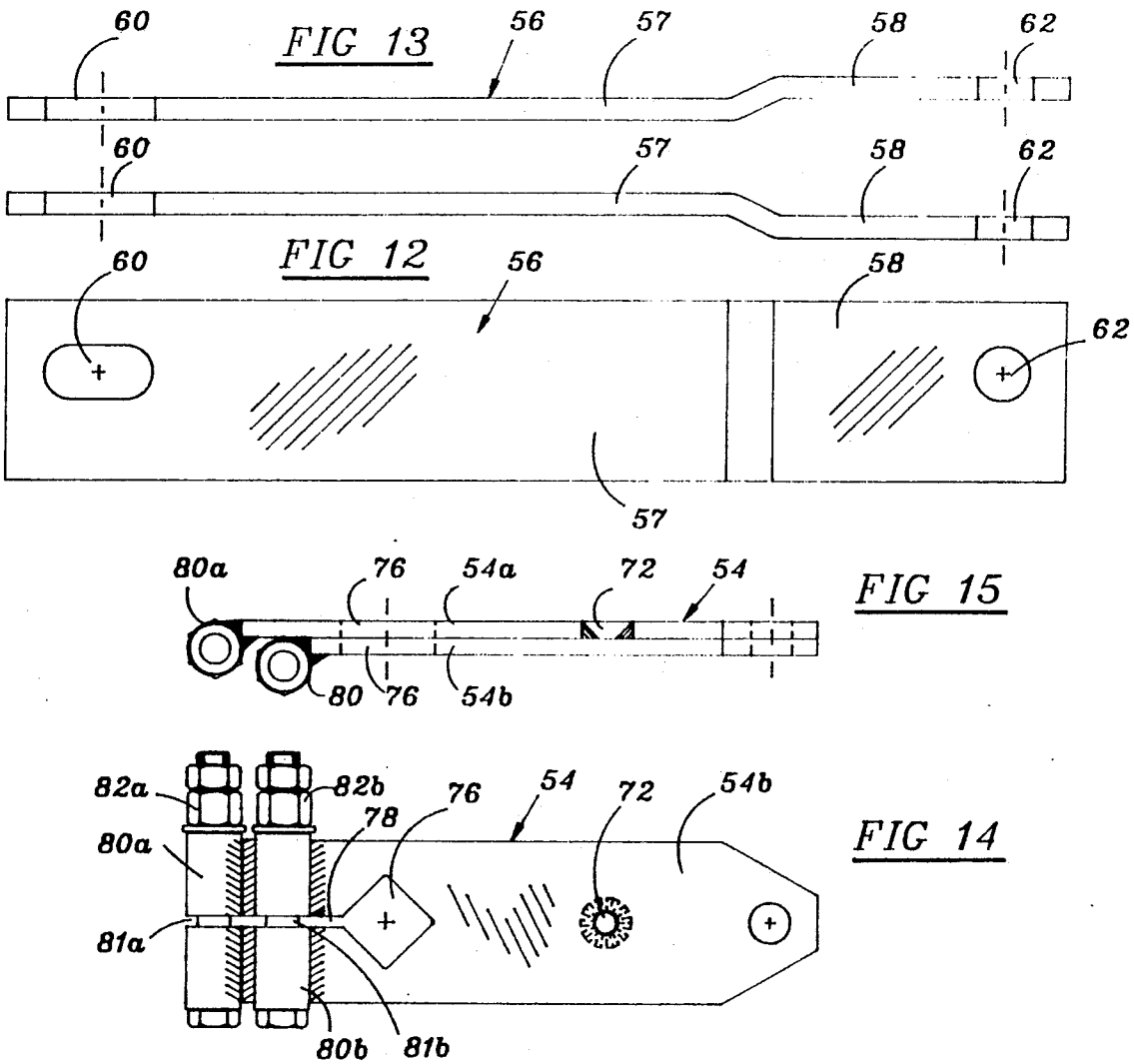
FIG. 12 is a side elevational view of the extension assembly used with the dump bar linkage of FIG. 6.
FIG. 13 is a top plan view of the extension assembly of FIG. 12.
FIG. 14 is a side elevational view of a dump bar lever assembly used in the dumping system of FIG. 1.
FIG. 15 is an end elevational view of the dump bar lever assembly of FIG. 14.

The dump bar levers 54 each include a pair of bars 54*a,b* positioned in sandwiched relation. The upper end of dump bar levers 54 are pivotally supported between bars 44 of dump bar linkage 42 by nut and bolt assembly 52. The details of dump bar levers 54 are best shown in FIGS. 14 and 15. The other dump bar lever 66 used with third trailing row of tray assemblies 4 is identical in construction to dump bar levers 54 except that notch 70 is provided for clearance when the leading tray assembly 4 of the adjacent rows of three or other number of tray assemblies 4 is initially raised for dumping. The other details of dump bar lever 66 should be apparent from the following description of one of the dump bar levers 54 shown in FIGS. 14 and 15.

As seen in FIGS. 14 and 15, the two bars 54*a,b* of dump bar levers 54 are welded to together by plug weld 72. The tops of bars 54*a,b* include cut-off portions at areas generally disposed between dump bar linkage 42. The bar 54*a* is longer than bar 54*b*, but both include a rectangular aligned hole 76. An open ended slot 78 extends between the hole 76 and the edges of the respective bars 54*a,b*. An internally threaded sleeve 80*a*, 80*b* having a spaced intermediate section 81*a*, 81*b* is respectively welded across slot 78 and receives nut and bolt assemblies 82*a*, 82*b* to tighten or loosen rectanglular hole 76 as will be described.

Referring now to FIGS. 1,2,8 and 9, the aisle tray dump bar assembly 90 is shown. The aisle dump bar assembly 90 couples the dump bar levers 54 and 66 to a respective row of tray assemblies 4. The assembly 90 includes a hollow pipe 92 extending through wall 8 and wall plate 8', and having a flat plate 94 welded at one end. The plate 94 is affixed to the tray assembly 4 by bolts (not shown) and transmits rotation of the bar assembly 90 to tray assembly 4. The aisle end portion 98 of the bar 96, extending through pipe 92 with its opposite end suitably affixed to the row of tray assemblies 4 being controlled by dump bar levers 54 and 66, is narrowed into a rectangularly shaped configuration corresponding to the shape of holes 76 for insertion. The nut and bolt assembly 82*a* and 82*b* can be tightened and loosened to attach, remove or adjust the positioning of dump bar levers 54 and 66 in the aisle on a respective end 98 of aisle tray dump lever 90 by adjusting the amount of tension of the hole 76 on the aisle end portion 98 through altering the width of slot 78. Adjustment of dump bar levers 54 and 66 on the end 98 allows for proper alignment during installation and repair. It should be apparent that the dump bar levers 54 and 66 act as crank levers that transmit motion to a respective row of tray assemblies 4 to open or close the floor.

In operation of the dumping system 10 connected to three rows of trays as illustrated in FIG. 1, extension of extensible end 16 of the pneumatic cylinder 12 cause the dump bar linkage 42 and dump bar levers 54 to initially pivot the right two rows of tray assemblies 4 viewing FIG. 1 from a horizontal, closed position for dumping. Because of oblong hole 60, the trailing row of tray assemblies 4 does not immediately react to extension of the pneumatic cylinder 12 until movement of the oblong hole 60 relative to the inserted mounting nut and bolt assembly 63 attains physical contact. This delay permits the first two rows of tray assemblies 4 to pivot across the length of the row for an approximate extent of 20 degrees or other extent dependent on the length of oblong hole 60 and the like, before the trailing row of tray assemblies 4 begin an opening sequence. This delay action reduces the initial load on the pneumatic cylinder 12 at the outset for greater efficiency. Withdrawal of the extensible end 16 of the pneumatic cylinder 12 causes the tray assemblies 4 to return to a closed position.

Figure 4:
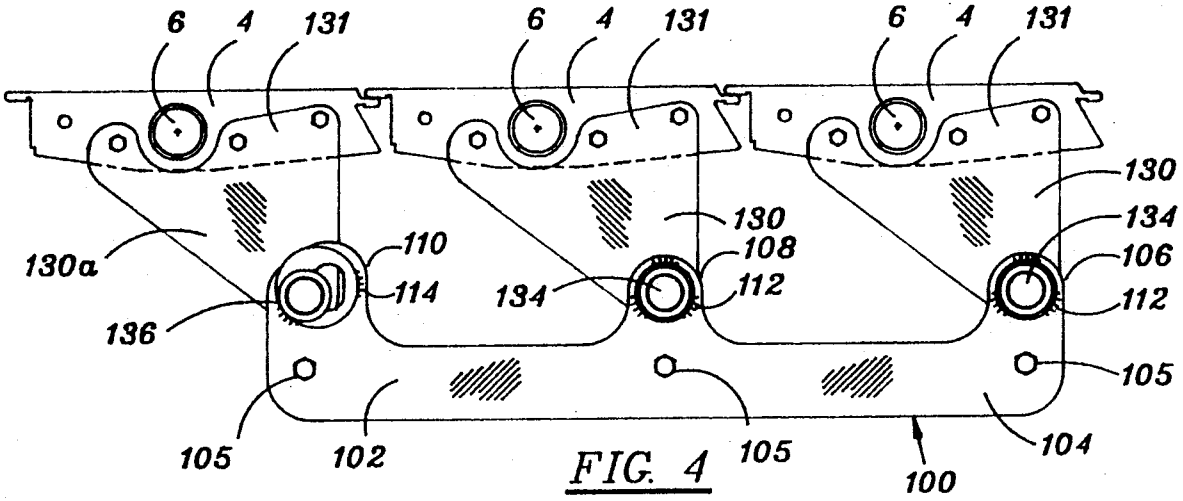
FIG. 4 is a partial side elevational view of the dump system of FIG. 1 taken from the opposite side of the tray assemblies of FIG. 1 showing the harmonizing bar assembly.
Figure 4A:
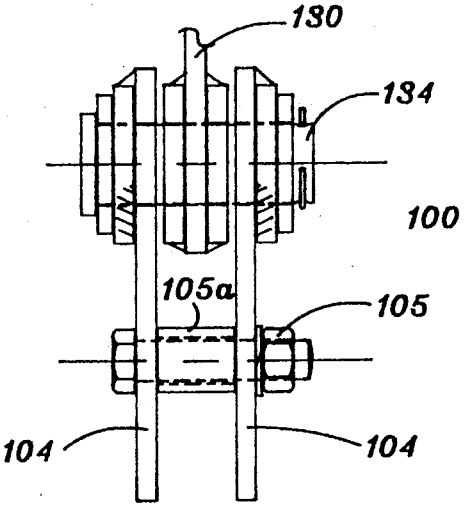
FIG. 4*a* is a partial end view of the the harmonizing bar assembly of FIG. 4.
Figures 4B, 5, 6, 7:
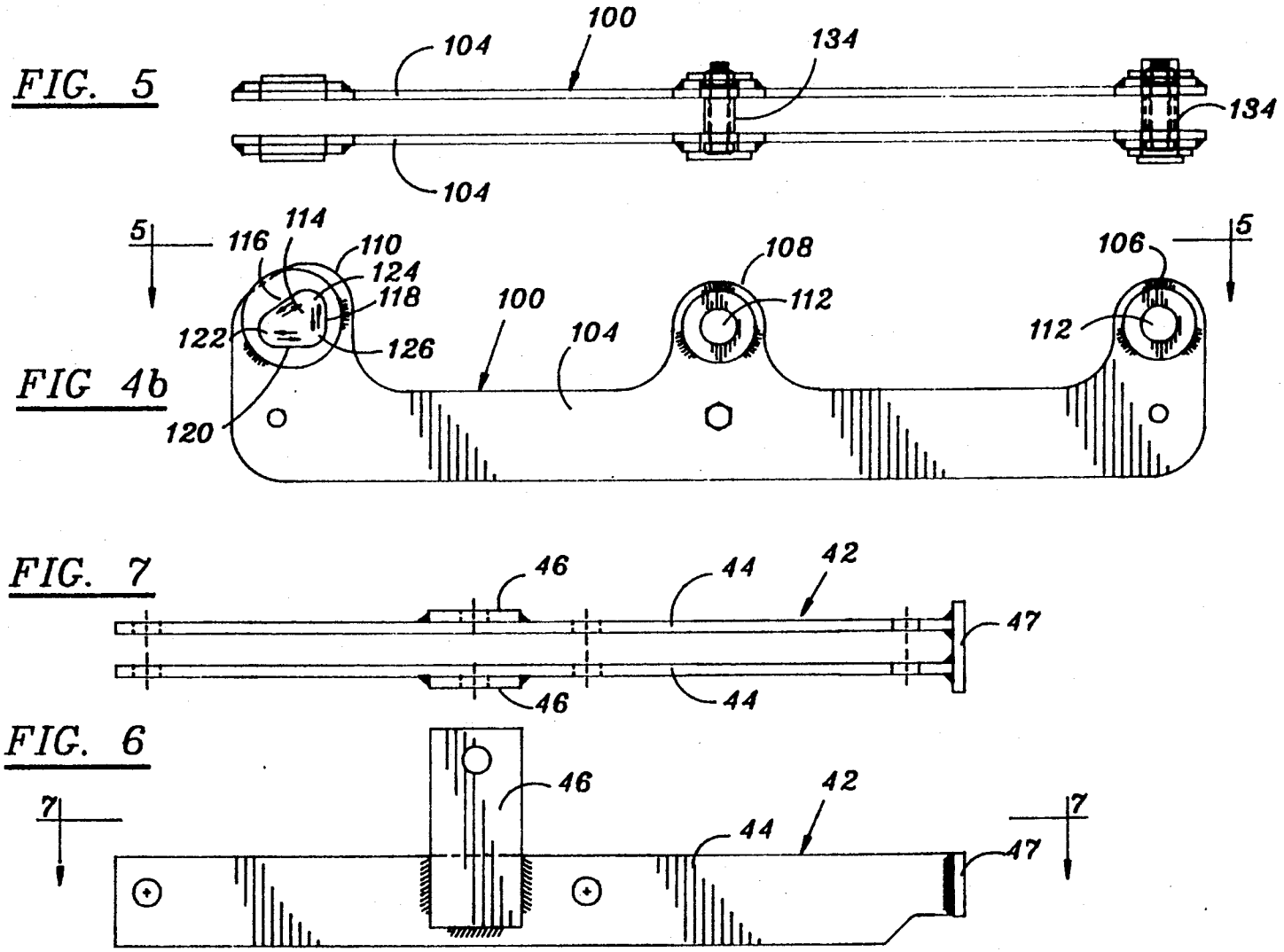
FIG. 4*b* is a side elevational view of the harmonizing bar assembly of the dumping system of FIG. 4.
FIG. 5 is a top plan view of the harmonizing bar assembly of FIG. 4.
FIG. 6 is a side elevational view of the dump bar linkage shown in FIG. 1.
FIG. 7 is a top plan view of the dump bar linkage of FIG. 6.
Figure 8:
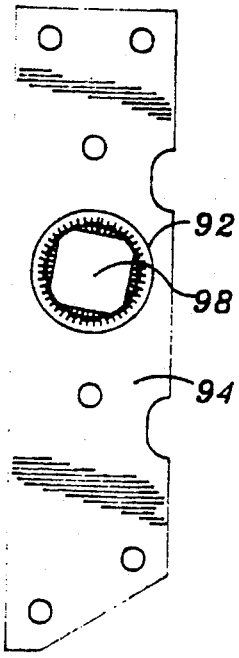
FIG. 8 is a side elevational view of the aisle tray bar linkage used with the dumping system of FIG. 1.
Figure 9:
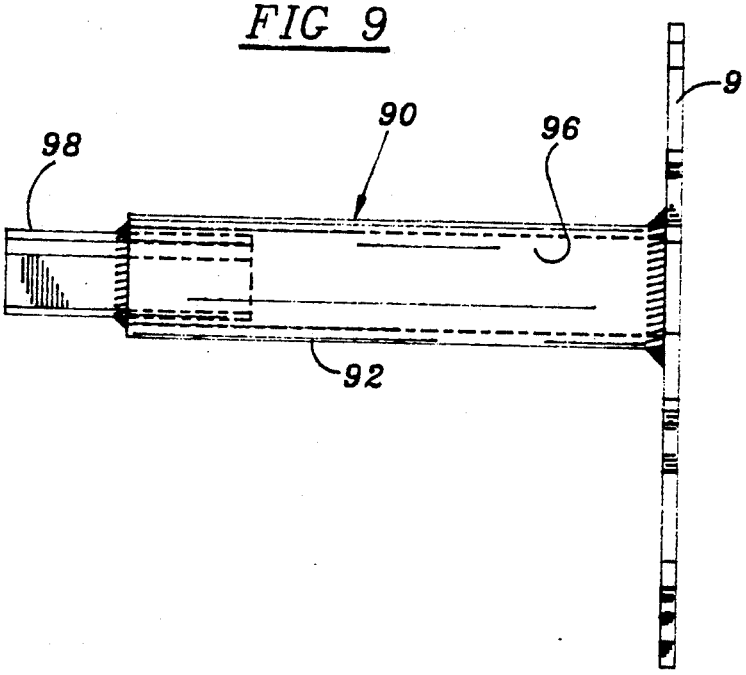
FIG. 9 is an end elevational view of the aisle tray dump bar linkage of FIG. 8.

The foregoing opening and closing of the tray assemblies 4 is synchronized by a harmonizing bar assembly 100, best illustrated in FIGS. 1, 4, 4*a*, 4*b*, and 5. The harmonizing bar assembly 100 insures a smooth opening and closing sequence and reduces bending along the row of tray assemblies 4. As seen in FIGS. 5 and 6, the harmonizing bar assembly 100 includes two spaced horizontal bars 104 attached in spaced relationship by bolt assemblies 105 in conjunction with spacer sleeve 105*a* (FIG. 4*a*). Three spaced projections 106, 108, and 110 are mounted on the top of bars 104. The projections 106 and 108 possess circular holes 112, while projection 110 includes a triangular-like hole 114. Hole 114 is formed with three linear sections 116, 118, and 120 (FIG. 4*b*) which are respectively separated by sections 122, 124, and 126 defined by a curved edge of hole 114.

Figure 10:
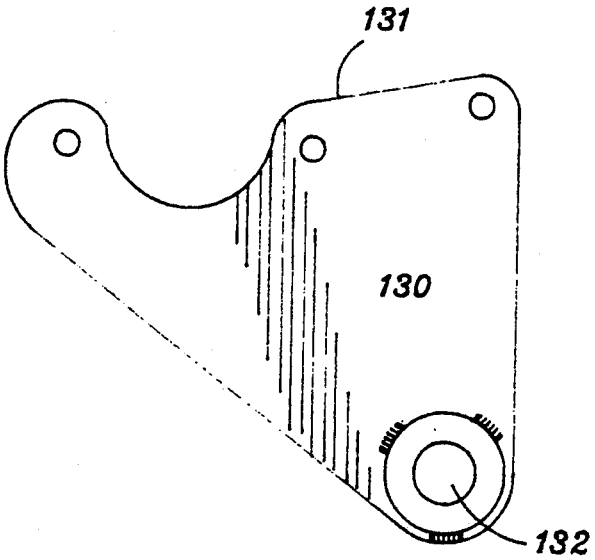
FIG. 10 is a side elevational view of the actuating plate used with the harmonizing bar assembly of FIG. 3.
Figure 11:
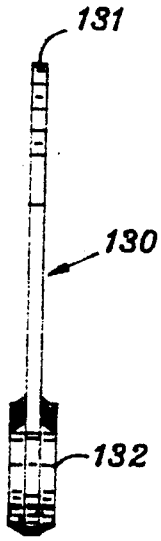
FIG. 11 is an end elevational view of the actuating plate of FIG. 10.

Each row of tray assemblies 4 is coupled to harmonizing bars 102 by a modified triangularly shaped actuator plate 130 or 130*a* as best shown in FIGS. 4, 10 and 11. The top 131 of actuator plates 130 is suitably affixed to the opposite end of a row of tray assemblies 4 than pneumatic cylinder 12 by being suitably affixed to the end tray assembly by attachment means disposed on both sides of the pivot axis 6. Two of the actuator plates 130 are pivotally affixed at their bottom between bars 104 by pin and sleeve assembly 134 mounted in holes 112. The third actuator plate 130*a* is mounted by a pin and sleeve assembly 136 extending through triangular hole 114. During actuation of the dumping system 10 at the end of the rows of tray assemblies 4 illustrated, harmonizing bar assembly 100 permits the initial two rows of tray assemblies 4 being raised to rotate upward. As the two rows of tray assemblies 4 are being raised with the third row being delayed as previously described, the pin and sleeve assembly 136 moves initally in hole 114 from section 122 upward to section 124 and finally down to section 124 as illustrated by arrows in FIG. 4*b*. In the fully raised position of all three rows of tray assemblies 4 or in their fully closed position, the pin and sleeve assembly 136 is positioned in section 122 of hole 132. One function of the harmonizing bar assembly 100 is to secure each row of tray assemblies 4 in a fully closed or fully opened position with or without an auxillary locking mechanism for safety and operating considerations. The harmonizing bar assembly 100 also allows the dumping system of the invention to be used with a existing weak or flexible tray in service. The harmonizing bar assembly 100 also synchronizes the opening and closing of the tray assemblies 4. It should be apparent that a plurality of harmonizing bar assemblies 100 along the full extent of rows of trays of the kiln floor in coordination with the plurality of pneumatic cylinders 12 employed.

Referring to FIG. 16, the dumping system 10*a* at the right is coupled to two rows of tray assemblies 4*a*, but which pivot in the opposite direction than tray assemblies 4. The extensible end 16 of pneumatic cylinder 12 is connected to a dump bar linkage 42*a* through plate 46*a*. Two dump bar levers 54' are respectively affixed to the shafts of the tray assemblies 4*a* in the same manner as previously described dump bar levers 54 and are of the same construction. As seen in FIG. 16, the rows of tray assemblies 4*a* are opened by withdrawal of extension end 16 and are closed by its extension to rotate the tray assemblies 4*a* in an opposite direction than tray assemblies 4. A modified harmonizing bar (not shown) may also be mounted on the opposite end of rows 4*a* to perform a similar function as harmonizing bar 100 previously described. In FIG. 16, it should be apparent that the end of bar linkage 42*a* is spaced from the end of the adjacent bar linkage 42 in the closed configuration of the kiln floor. This clearance permits the first rows of the kiln floor to initially open without interference for a dumping sequence.

Figure 17:
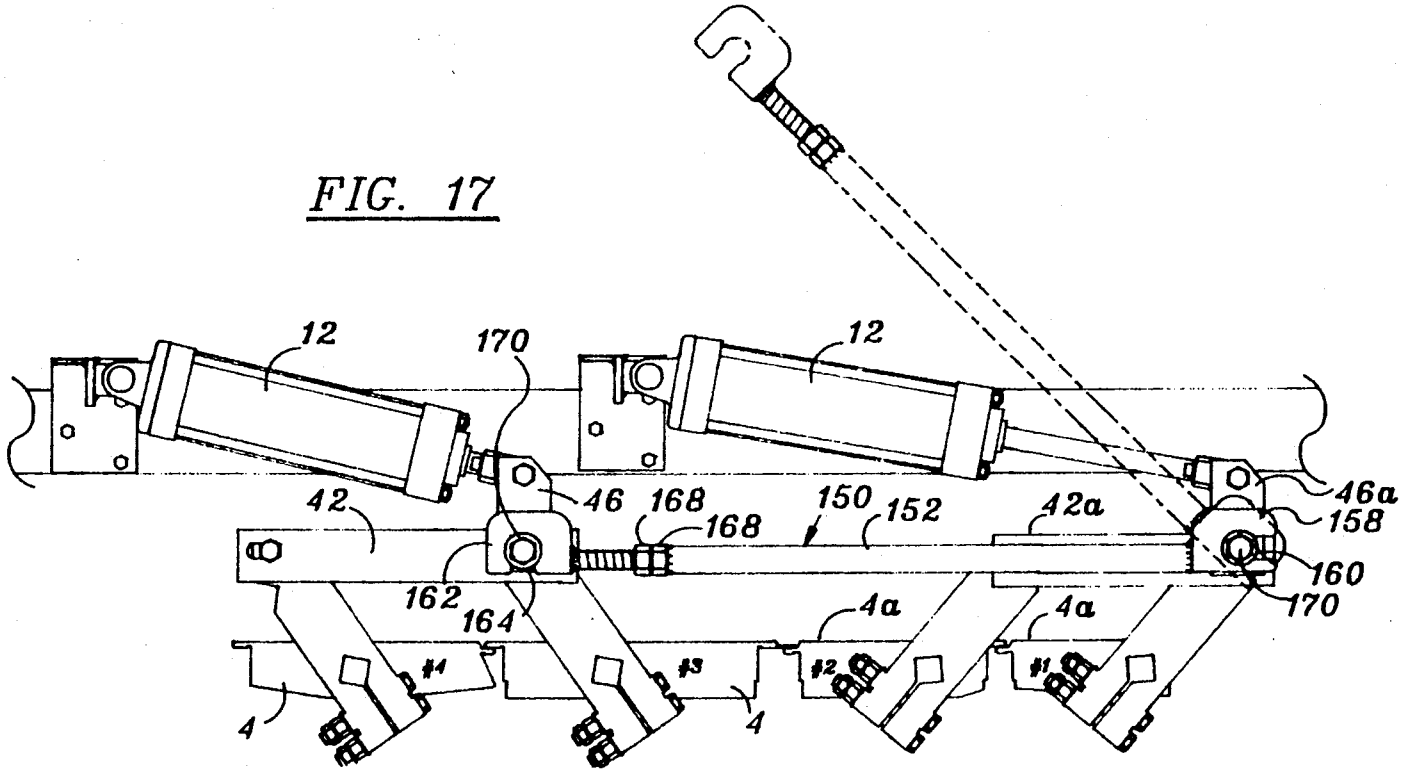
FIG. 17 is a side elevational view of the intruder bar assembly of the invention in position to lock the kiln floor of FIG. 16 in a closed position.
Figure 18:
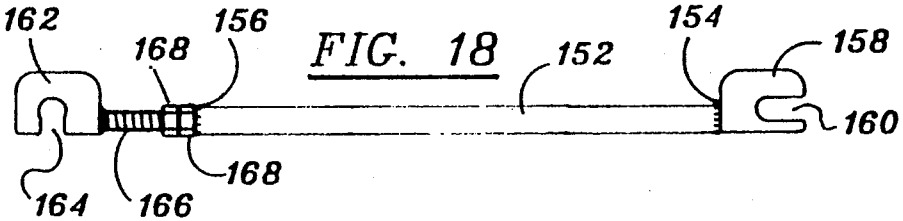
FIG. 18 is a side elevational view of the intruder bar assembly of FIG. 17.

Referring now to FIGS. 17 and 18, there is illustrated the intruder bar assembly 150 of the invention arranged to span the clearance between the ends of the bar linkage 42*a* and the adjacent bar linkage 42. It is the function of intruder bar assembly 150 to lock the entire floor in its closed position in conjunction with the harmonizing bar assemblies 100. The intruder bar assembly 150 insures that the floor is locked and none of the tray assemblies can open when personnel is on the kiln floor or grain turning machines are operating during th drying cycle. In the latter situation grain turning machines can cause significant damage if a row of tray assemblies 4, 4*a* is even just partially open. As seen in FIG. 18, the intruder bar assembly 150 includes an elongated tube 152 having a fixed end 154 and an adjustable end 156.

A bracket 158 having an axially open slot 160 is mounted on the fixed end 156. A second bracket 162 having laterally extending open slot 164 is affixed to the adjustable end 156. Adjustment of the end of the intruder bar 150 at the adjustable end 156 is accomplished by a threaded shaft 166 being received in the open end of tube 152. A pair of nuts 168 are affixed to threaded shaft 166 to lock the adjustable end at a length matching the appropiate distance between the bar linkage 42a and bar linkage 42, namely between bolts 170 positioned at the connections of plate 46, 46a to the bar linkages 42, 42a. The open ended slot 160 is manually inserted over a protruding portion of the bolt 170 at plate 46a and is swung down (in phantom in FIG. 18) with open ended slot 164 being placed over bolt 170 at plate 46, after any adjustment of the length of the intruder bar being needed. When the kiln floor is to be opened for dumping, the intruder bar 150 is simply pivoted up and removed to create the clearance that was previously described. For sake of illustration, two tray assemblies 4a are shown, but clearance may be provided between adjacent three or more rows of tray assemblies 4,4a, if appropiate. Only one intruder bar assembly 150 is required to lock the floor assembly in conjunction with the harmonizing bar assemblies, but others may be used where other clearances are present in the kiln floor.

Referring to FIG. 3 there is illustrated another dumping system of the invention, generally designated by reference numeral 2'. The dumping system 2' includes a pneumatic cylinder which is only directly connected to the first row of tray assemblies 4 through a single dump bar lever 54' of the same construction as dump bar levers 54 previously described. The upper portion of dump bar lever 54' is directly affixed to the extensible end 16 by a suitable connection. The lower portion of dump bar lever 54 is affixed to end 98 of the tray shaft as in the previous embodiment. The harmonizing bar assembly 100' is of the same construction and includes the same components designated by corresponding reference numerals with the prime designation as described with reference to harmonizing bar assembly 100. In FIG. 3, the harmonizing bar assembly 100' is shown mounted directly on the opposite side of wall 8 from the pneumatic cylinder 12 in aisle, although harmonizing bar assembly 100' may also be situated on the far side of the kiln floor as in the embodiment of FIG. 1. Extension of the extensible end 16 effects rotation of the connected row of tray assemblies 4 while the remaining two rows are pivoted through transmittal of energy of pneumatic cylinder 12 through the coupling of the haromonizing assembly 100'. The embodiment of FIG. 3 has particular application where floor loadings are not severe or where trays easily rotate. The dump bar lever 54' can alternatively be directly attached to any of the other two rows for operation, if desired.

In FIG. 16 an important aspect of the invention is apparent. The trailing end 200 of the extension 56 of the dump bar linkage 42 of one group of tray assemblies 4 connected to a common cylinder 12 is arranged to abut the leading edge 202 of the dump bar linkage 42 of the adjacent tray assembly 4 when the tray assemblies 4 are closed. Such contact at ends 200 and 202 creates a continuous linkage of dump bar linkages 42 along the floor, other than the previously described clearance adjacent bar linkage 42a. The contacting bar linkages prevent the adjacent groups of tray assemblies 4 from opening until the preceeding dump bar linkage 42 has moved out of contact when opened. The continous dump bar linkage thus created prevents independent movement of any row of tray assemblies 4, even in absense of harmonizing assemblies 100.

What is claimed is:

1. A dumping system for a kiln floor comprising a plurality of rows of tray assemblies forming the kiln floor in a horizontal position, shaft means for mounting each of said rows of tray assemblies for pivotal movement about a respective horizontal axis between said horizontal position and an open position for dumping material arranged on the floor, power means for effecting said pivotal movement of said plurality of rows of tray assemblies on said shaft means between said horizontal position and said open position, linkage means connecting said power means to said plurality of rows of tray assemblies for effecting said pivotal movement, said linkage means having first delay means for delaying said pivotal movement of at least one of said rows of tray assemblies until the other of said plurality of rows of tray assemblies have initiated said pivotal movement from said horizontal position to said open position, harmonizing means operatively connected to said shaft means at a position horizontally spaced from said linkage means, and said harmonizing means locking said plurality of rows of tray assemblies in said horizontal position and in said open position, said harmonizing means being operatively connected to said shaft means of said at least one of said rows of tray assemblies, said harmonizing means further having second delay means for permitting said delay of pivotal movement of said at least one of said rows of tray assemblies.

2. The dumping system according to claim 1 wherein said harmonizing means includes a bar attached to said shaft means and having a plurality of actuators corresponding to the number of said plurality of rows of tray assemblies, each of said actuators being pivotally affixed to said shaft means of a respective row of said plurality of rows of tray assemblies, attachment means for pivotally mounting said plurality of actuators about separate pivotal axes disposed parallel to said respective horizontal axes, said attachment means of at least one of said actuators being moveable perpendicular to at least one of said horizontal axes during said pivotal movement of said tray assemblies between said horizontal position and said open position.

3. The dumping system according to claim 2 wherein said second delay means includes at least one hole having a modified triangular configuration, said attachment means of said at least one of said actuators being moveable laterally in said at least one hole to shift the pivot axis of said least on of said actuators for said delay of said pivotal movement.

4. The dumping system according to claim 1 wherein said linkage means includes a linkage bar operatively connected to said power means, said linkage means further having a plurality of levers pivotally connected to said linkage bar and being respectively connected to said shaft means of each of said plurality of rows of tray assemblies.

5. The dumping system according to claim 4 further including adjustment means carried by each of said levers, said adjustment means permitting adjustment of said connection of said plurality of levers relative to said plurality of rows of tray assemblies during assembly.

6. The dumping system according to claim 1 wherein said plurality of rows of tray assemblies comprises three rows.

7. A dumping system for a kiln floor comprising a plurality of rows of tray assemblies, shaft means for pivotally mounting said rows of tray assemblies on a respective axis, power means being operatively connected to said shaft means of said plurality of rows of tray assemblies at a first position along each of said pivot axes to effect movement of said plurality of rows of tray assemblies between a closed position and an open position, harmonizing bar means being operatively connected to said shaft means of said plurality of rows of tray assemblies at a second position spaced from said first position along each of said pivot axes, said harmonizing means acting to lock said plurality of rows of tray assemblies in said closed position and said open position, said harmonizing means having an enlarged opening permitting movement of at least one of said shaft means relative to said harmonizing means, said shaft means being positioned in a locked relationship in said enlarged opening at a first position of said at least one of said shaft means in said enlarged opening, and said at least one of said shaft means being moveable in said opening during opening and closing of said tray assemblies.

8. The dumping system according to claim 7 wherein said harmonizing means includes means to permit movement f said plurality of rows of tray assemblies between said closed position and said open position when effected by said power means.

9. The dumping system according to claim 8 wherein said harmonizing bar means includes a bar, said bar having a plurality of actuators, pin means for pivotally mounting said plurality of actuators on said bar about separate axes, and said plurality of actuators being respectively attached to said shaft means said plurality of rows of tray assemblies.

10. The dumping system according to claim 9 wherein at least one of said pin means moves transverse of at least one of said separate pivot axes during said movement of said tray assemblies.

11. The dumping system according to claim 10 wherein said bar includes at least one hole having a modified triangular shape, said at least one of said pin means being positioned in said at least one hole for said transverse movement therein.

12. The dumping system according to claim 11 wherein said at least one pin means is positioned in a first position of said at least one hole in said closed position of said plurality of rows of tray assemblies and in a second position of said at least one hole in said open position of said plurality of rows of tray assemblies.

13. The dumping system according to claim 12 wherein said pin means moves away from said first position of said at least one hole during said movement of said plurality of rows of tray assemblies between said closed position and said open position.

14. The dumping system according to claim 10 wherein some of said pin means pivotally mount a respective actuator at a fixed rotatable position on said bar.

* * * * *